US011284665B2

(12) United States Patent
Hatzis

(10) Patent No.: US 11,284,665 B2
(45) Date of Patent: Mar. 29, 2022

(54) PEDITRACK

(71) Applicant: Angela A. Hatzis, Floral Park, NY (US)

(72) Inventor: Angela A. Hatzis, Floral Park, NY (US)

( * ) Notice: Subject to any disclaimer, the term of this patent is extended or adjusted under 35 U.S.C. 154(b) by 143 days.

(21) Appl. No.: 16/926,917

(22) Filed: Jul. 13, 2020

(65) Prior Publication Data

US 2020/0337411 A1 Oct. 29, 2020

Related U.S. Application Data

(63) Continuation-in-part of application No. 15/958,240, filed on Apr. 10, 2018, now abandoned.

(51) Int. Cl.
*A43B 3/10* (2006.01)
*A43B 3/12* (2006.01)

(52) U.S. Cl.
CPC ..... *A43B 3/122* (2013.01); *A43B 3/101* (2013.01)

(58) Field of Classification Search
CPC ..... A43B 7/26; A43B 3/102; A43B 3/103; A43B 3/105; A43B 3/122; A43B 3/126
See application file for complete search history.

(56) References Cited

U.S. PATENT DOCUMENTS

| | | | | |
|---|---|---|---|---|
| 736,194 | A * | 8/1903 | Bassett | A43B 3/126 36/11.5 |
| 1,875,162 | A * | 8/1932 | Sayers | A43B 7/26 36/11.5 |
| 2005/0229430 | A1* | 10/2005 | Takaba | A43B 7/26 36/11.5 |
| 2011/0173843 | A1* | 7/2011 | Bishop | A43B 7/26 36/92 |
| 2015/0068059 | A1* | 3/2015 | Kinchington | A43B 7/26 36/11.5 |
| 2016/0227875 | A1* | 8/2016 | Flickinger | A43B 13/141 |
| 2018/0007997 | A1* | 1/2018 | Young | A43B 13/12 |
| 2020/0060382 | A1* | 2/2020 | Pepper | A43B 3/128 |
| 2021/0251791 | A1* | 8/2021 | Jung | A43B 7/26 |

* cited by examiner

*Primary Examiner* — Ted Kavanaugh

(57) ABSTRACT

A footwear includes a base, a one-inch cushiony toe separator, and a strap. The base has a first end and a second end, and the one-inch cushiony toe separator is disposed proximate to the first end. The one-inch cushiony toe separator is adapted to dispose between a big toe of the foot and a second toe of the foot to facilitate a separation of the big toe from the second toe. Further, the one-inch cushiony toe separator includes a width of one inch. Moreover, the strap includes a lateral strap portion and a longitudinal strap portion extending from the lateral strap portion to the one-inch cushiony toe separator. The lateral strap portion and the longitudinal strap portion together are adapted to enclose at least a second bone of the big toe to facilitate an alignment of the second bone.

7 Claims, 2 Drawing Sheets

PEDITRACK

TECHNICAL FIELD

The present disclosure relates to bunion corrector footwear, more specifically, the invention called PEDITRACK, the disclosure of which relates to a footwear designed for bunion correction, by implementing continuous support and healing for existing bunions without any surgical intervention. The design also helps in preventing of bunion formation due to misalignment of the big toe.

BACKGROUND OF THE DISCLOSURE

Generally, people use footwears such as, sandals, flip-flops, slippers etc., often while walking, running, or undertaking physical workouts. The PEDITRACK footwear protects the foot directly as it performs walking, a means essential for humans.

Hallux (i.e. the big toe) is comprised of two bones, the first one, which is a small bone where the nail is, and the second and larger bone, which is in direct alignment with the metatarsal bone. When the second bone of the big toe, moves out of its normally straight position of alignment with the metatarsal bone, that forms the bunion.

As a bunion deformity progresses, a characteristic bump forms and grows below the second bone of the big toe. The act of walking requires the big toe to support a great deal of the body's weight and therefore actuates the progression of the bunion. Without the bunion correction the aforementioned bunion could increase in severity, and cause other associated foot problems to develop, such as hammertoes, painful calluses on the bottom of the foot, arch pain and the like.

As noted above, bunions arise from mechanical instability within the foot, resulting in a misalignment of the big toe, specifically between its second and larger bone, with its corresponding metatarsal bone of the foot. Subsequently the big toe drifts either over or under the second toe. As a bunion deformity progresses, a characteristic bump forms and grows below the second bone of the big toe. The act of walking requires the big toe to support a great deal of the body's weight and therefore actuates the progression of the bunion. Without the PEDITRACK bunion correction the aforementioned bunion could increase in severity, and cause other associated foot problems to develop, such as hammertoes, painful calluses on the bottom of the foot, arch pain and the like.

Pain from a bunion can range from mild to severe, making it difficult to walk. The skin and deeper tissues around the bunion may also become swollen or inflamed. Moreover, the other toes may be affected by the bunion, such as by result of pressure from the big toe urging the lesser toes inwardly. When left untreated, bunions tend to grow larger and, usually, more painful. One common bunion treatment that has been used is to pad the bunion. While effective in temporarily diminishing the pain associated with the bunion, padding does not address the cause of the bunion. And does not reverse the bunion condition. Likewise, medications, such as anti-inflammatory drugs or cortisone injections may be administered to ease pain and inflammation caused by joint deformities. However, such medications do not correct or reverse such ongoing joint deformity.

SUMMARY

In an aspect of the present disclosure, a footwear for supporting a foot of a wearer is disclosed. The footwear includes a base, a one-inch cushiony toe separator and a strap or band. The base has a first end and a second end disposed opposite to the first end, and the one-inch cushiony toe separator is disposed proximate to the first end and extends outwardly from base. The one-inch cushiony toe separator is adapted to dispose between the big toe of the foot and a second toe of the foot to facilitate and enforce a separation of the big toe from the second toe. Further, the one-inch cushiony toe separator footwear includes a strap having a lateral strap portion and a longitudinal strap portion extending from the lateral strap portion to the one-inch cushiony toe separator. The lateral strap portion and the longitudinal strap portion together are adapted to enclose the second bone of the big toe to facilitate an alignment of the second bone with a metatarsal bone of the foot, and therefore facilitate healing and correction of the bunion.

BRIEF DESCRIPTION OF THE DRAWINGS

Figure 1:
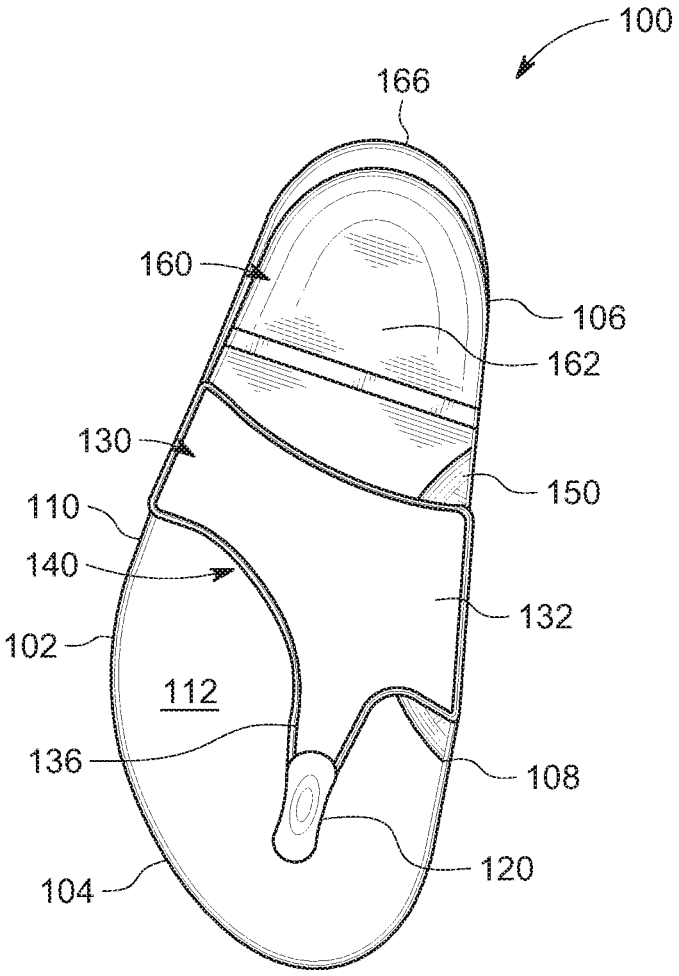
Figure 2:
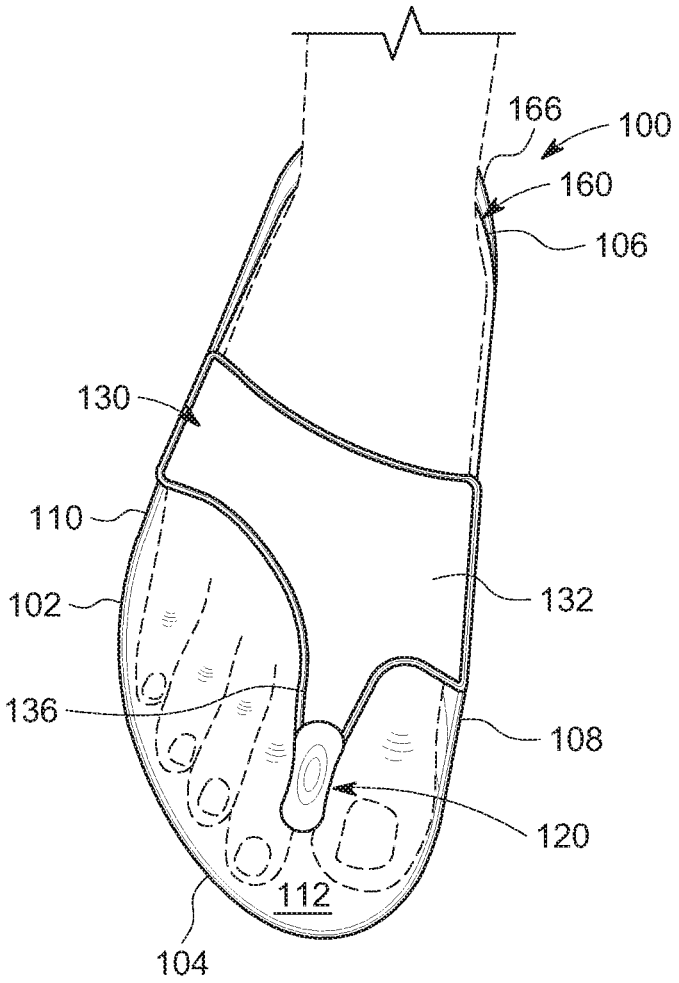

Having thus described example embodiments of the invention in general terms, reference will now be made to the accompanying drawings, which are not necessarily drawn to scale, and wherein:

FIG. 1 illustrates a footwear depicting a one-inch cushiony toe separator, in accordance with an embodiment of the present disclosure; and FIG. 2 illustrates the footwear of FIG. 1 supporting a foot of a wearer, in accordance with an embodiment of the present disclosure.

DETAILED DESCRIPTION

Some embodiments of the present PEDITRACK invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Also, reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Footwear with bunion corrector is provided herein in accordance with an embodiment for bunion prevention and also the healing of existing bunions without any surgical intervention.

FIG. 1 illustrates a footwear 100, in accordance with an embodiment of the present disclosure. In some example embodiments, the footwear 100 may include, but not limited to flip-flops, slippers, sandals, etc. The footwear 100 may include a base 102 adapted to support a foot, of a wearer and having a front end 104, a rear end 106, a first longitudinal edge 108 extending from the front end 104 to the rear end 106, a second longitudinal edge 110 disposed spaced apart from the first longitudinal edge 106 and extending from the front end 104 to the rear end 106, a top surface 112, and a bottom surface (not shown) adapted to contact a ground. The footwear 100 may include a flexible engineered padded foot beds to alleviate strain on the plantar fascia and increase blood circulation. The footwear 100 includes a one-inch cushiony toe separator 120 extending outwardly and away from the top surface 112 of the base 102 and arranged proximate to the front end 104. The one-inch cushiony toe separator 120 is adapted to be disposed between a big toe and a second toe of the wearer when the wearer wears the footwear 100 in the foot. Therefore, the one-inch cushiony toe separator 120 is configured to separate the big toe of the wearer from the second toe of the wearer. In an embodiment, the one-inch cushiony toe separator 120 may include a material suitable to provide a cushioning effect to the wearer. In an embodiment, the one-inch cushiony toe separator 120 may include a cushion pad. In an embodiment, the cushion pad may be made of rubber or any other suitable material that may be get pressed when the One inch cushiony toe separator is arranged between the big toe and the second toe of the wearer. In an embodiment, the cushion pad may include gel type material to provide cushioning effect. The cushiony gel of the one-inch cushiony toe separator 120 may facilitate in comfortably keeping the toes separated to correct bunions and promote proper foot alignment. By separating the toes, the footwear 100 will reduce rubbing and ease discomfort caused by bunions without having to undergo debilitating surgery. Further, the one-inch cushiony toe separator includes one-inch width to ensure proper separation of the big toe from the second toe to facilitate in correction of the bunion.

The one-inch cushiony toe separator 120 separates the big toe (i.e. hallux) of the foot or the wearer from the second toe of the wearer by keeping the big toe one inch apart from the second toe. At the same time, the one inch cushiony toe separator 120 forces the big toe (specifically a second bone of the big toe) to return to its original straight position which is in alignment with a metatarsal bone of the foot of the wearer. In this manner, the one-inch cushiony toe separator 120 effectively treat bunions and improve foot function.

The footwear 100 further includes a strap 130 having a lateral strap portion 132 extending from the first longitudinal edge 108 to the second longitudinal edge 110 and a longitudinal strap portion 136 extending from the lateral strap portion 132 and connected to the one inch cushiony toe separator 120. In an embodiment, the one-inch cushiony toe separator 120 may be integrally formed with the longitudinal strap portion 136. The lateral strap portion 132 and the top surface 112 of the base 102 or sole defines a cavity 140 therebetween to receive a middle portion of the foot. Further, the longitudinal strap portion 136 is arranged proximate to the first longitudinal edge 108 relative to the second longitudinal edge 110. Also, a width 'W' of the lateral strap portion 132 disposed between the first longitudinal edge 108 and the longitudinal strap portion 136 is selected so as to cover a portion of the big toe. In an embodiment, the width 'W' is such that the lateral strap portion 132 encloses a second bone of the big toe. Therefore, the lateral strap portion 132 and the longitudinal strap portion 136 together are adapted to enclose the second bone of the big toe. The width of the lateral strap portion 132 could be wider or shorter on the side of the small toe, according to individual preference.

Therefore, the strap 130 secures the big toe (specifically the second bone of big toe) in a straight position, which is caused by the one-inch cushiony toe separator 120. Accordingly, the strap 130 supports and secures the realignment of the big toe with its metatarsal bone. The strap 130 provides much-needed metatarsal support while realignment is taking place and bunion is being, corrected. A width of the lateral strap portion 132 disposed on the side of the bunion is such that the lateral strap portion 132 accommodate and covers the affected second bone of the big toe and therefore the bunion.

The footwear 100 may further include an arch support 150 for supporting the anatomical arch of the foot of the wearer. The arch support 150 is arranged at a middle portion of the footwear and arranged proximate to the first longitudinal edge 110 of the base 102. Also, the arch support 150 includes a substantially convex shape having relatively greater thickness in the middle. It may be appreciated that a thickness of the arch support 150 decreases from the middle to its longitudinal edges. The arch support 150 extends upwardly from the top surface 112 and is connected to the top surface 112. In an embodiment, the arch support 150 may be integrally formed with the base 102 of the footwear 100. The arch support 150 helps improve the posture and balance which can help lessen foot pain and problems related to imbalance and a lack of proper support.

The footwear 100 may further include a heel cup 160 for supporting a heel of the wearer. As shown, the heal cup 160 is arranged proximate to the rear end 106 of the base and adapted to raise and support the heel of the wearer. As shown, the heel cup 160 may include a flat portion 162 disposed along a portion of the top surface 112 and extending upwardly from the top surface 112 of the base 102 and an arcuate portion 166 extending upwardly and outwardly from an arcuate edge of the flat portion 162. In an embodiment, the arcuate portion 166 is arranged at the rear end 108 of the base 102 and extends upwardly from a rear edge of the base 102. The arcuate portion 166 is adapted to cover a portion of the heel. The heel cup 160 (i.e. the flat portion 162) address foot pain by lifting the heel of the wearer slightly which reduces tension on the achilles tendon, in turn alleviating pressure on the plantar fascia. The heel cup 160 also provides shock absorption for the heel, which further reduces stress on the plantar fascia. In an embodiment, the heel cup is integrally formed with the base of the footwear. The footwear 100 enables the toes and the feet to move naturally while keeping the alignment.

In some embodiments, the one-inch cushiony toe separator 120 will prevent toe rubbing that will result in reducing the risk of bunions, promote healing of existing ones and prevent corns developing between the toes. For existing corns, separating the toes may allow the skin to recover. In some example embodiments, the flip-flops, slippers, sandals may have two types of widths of their supportive band on top according to individual preference. In some example embodiment, the flip-flops, slippers and sandals with a built-in bunion correction splint will be comfortably worn all day, as it will enable the toes and the feet to move naturally while keeping their alignment.

In some example embodiments, the footwear 100 will ease the discomfort, pressure and inflammation caused by bunions and will provide amazing relief all day. Further, the footwear 100 will be manufactured for women and men as it is geared to provide comfort for both men and women.

The flip-flops, slippers and sandals will be made with the finest quality of materials. One hundred percent medical materials, with high-quality rubber which will produce a perfect product. The finest grade materials will definitely reduce the discomfort of a bunion and make every day walking or exercising, in or outside the house, a fun activity with the not much effort.

In some example embodiments, the foot bed of the footwear 100 will be made with high quality material in order to provide impact absorption, which would reduce the stress for feet and knees and lower back. It would also provide superior arch support and moisture resistance for prolonged use.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. A footwear for supporting the foot of a wearer, the footwear comprising:

a base having a first end and a second end disposed opposite to the first end;

a one inch cushiony toe separator disposed proximate to the first end and extending outwardly from base, the one inch cushiony toe separator is adapted to dispose between a big toe of the foot and a second toe of the foot to facilitate a separation of the big toe from the second toe, wherein the one inch cushiony toe separator includes a width of one inch to ensure the big toe remains one inch separated from the second toe; and a strap including a lateral strap portion and a longitudinal strap portion extending from the lateral strap portion to the one inch cushiony toe separator, wherein the lateral strap portion and the longitudinal strap portion together are adapted to enclose at least a second bone of the big toe to facilitate an alignment of the second bone with a metatarsal bone.

2. The footwear of claim 1, wherein one-inch cushiony toe separator provides a cushioning effect to the wearer.

3. The footwear of claim 1, further including an arch support disposed proximate to a first longitudinal edge of the base and extending from a top surface of the base to support an anatomical arch of the foot of the wearer.

4. The footwear of claim 1, further including a heel cup attached to the base and disposed proximate to the second end of the base.

5. The footwear of claim 4, wherein the heel cup includes a flat portion attached to a top surface of the base, the flat portion extends along the top surface, and an arcuate portion extending outwardly and substantially perpendicularly from an edge of the flat portion.

6. The footwear of claim 1, wherein the one-inch cushiony toe separator is integrally formed with the base.

7. The footwear of claim 1, wherein the one-inch cushiony toe separator is integrally formed with the strap.

* * * * *